US005524890A

United States Patent [19]

Kim et al.

[11] Patent Number: 5,524,890

[45] Date of Patent: Jun. 11, 1996

[54] GOLF CLUB

[76] Inventors: Jae S. Kim; Jim Kim, both of 29158 Oceanridge, Rancho Palos Verdes, Calif. 90275

[21] Appl. No.: 411,879

[22] Filed: Mar. 28, 1995

[51] Int. Cl.[6] ..... A63B 53/04

[52] U.S. Cl. ..... 473/242; 473/327; 473/328; 473/331

[58] Field of Search ..... 273/167 R, 77 R, 273/167 E, 167 D, 167 H, 186.2, 187.4, 167 A, 174, 169, 167 F, 164.1, 162 R, 167 J

[56] References Cited

U.S. PATENT DOCUMENTS

| | | | |
|---|---|---|---|
| 1,485,272 | 2/1924 | Kinsman | 273/164.1 |
| 2,766,047 | 10/1956 | Karns | 273/164.1 |
| 3,468,544 | 9/1969 | Antonious | 273/167 E |
| 3,997,170 | 12/1976 | Goldberg | 273/167 E |
| 4,065,133 | 12/1977 | Gordos | 273/167 E |
| 4,809,982 | 3/1989 | Kobayashi | 273/167 E |
| 5,054,784 | 10/1991 | Collins | 273/167 E |
| 5,158,296 | 10/1992 | Lee | 273/167 E |
| 5,213,329 | 5/1993 | Okumoto | 273/167 A |
| 5,271,622 | 12/1993 | Rogerson | 273/167 E |

*Primary Examiner*—Sebastiano Passaniti
*Attorney, Agent, or Firm*—Roger A. Marrs

[57] ABSTRACT

A golf club is disclosed herein having aerodynamic characteristics reducing drag resistance to maintain maximum head speed which includes a head having a front face with a top surface and an undersurface rearwardly sloping together to define a tapered back face. The sides of the head slope in convergence from the top surface to the undersurface. A pair of open-ended arcuate passageways are provided in the head substantially in parallel with a round opening at the front face and terminating in an oval exit at the back face. The radius of the arcuate passageways lies on the radius of the golfer's swing and a pointer is located on the top surface adjacent the front face to indicate alignment with sweet spot location on the front face. The undersurface includes a pair of ridges defining a central groove and opposite side grooves with terminations at the oval exits of the passageways.

1 Claim, 3 Drawing Sheets

GOLF CLUB

BACKGROUND OF THE INVENTION

1. Field of the Invention

The present invention relates to the field of athletic equipment and, in particular, to a novel golf club having a ball-striking head which is provided with open-ended grooves and passageways in order to conduct ram air through the head to reduce friction and drag as the club is swung by a golfer.

2. Brief Description of the Prior Art

In the past, it has been the conventional practice to provide a golf club having an elongated shaft which is held in the hand of a golfer at one end and a ball-striking head at its other end. The usual design and construction of the golf club head, particularly for a driver, includes a weighted mass having a front or forward flat surface intended to impact against a golf ball as the golfer swings the club through an arcuate path. In some instances, a circular plate is carried on the forward flat surface which is located in a special area known as the "sweet spot". Surrounding the "sweet spot" area is a flat surface against which the oncoming ram air impacts with the result that drag and friction slows the speed of the golfer's swing and therefore limits the forcible impact of the golf club head against the golf ball. Such a reduction in golf club swing speed greatly limits the distance that the ball may be driven from its starting point on a golf tee.

Some attempts have been made to reduce drag and friction by streamlining and aerodynamically shaping the golf club head so that laminar air flow about the outer surfaces of the head will reduce friction. However, the broad flat surface area on the front of the golf club head is a major speed limiting factor since the air resistance against the flat surface area greatly increases drag during the golfer's swing.

Reference is made to prior disclosures appearing in U.S. Pat. Nos. 1,008,571; 4,809,982; 4,930,783; 3,468,544; 5,158,296. These prior golf club heads disclose straight air conducting passageways but do not relate the linear passageways to the arc or curvature of the golf club swing. Also, the relationship of the undersurface or sole of the head to the conduction of passing ram air with respect to passageways and aerodynamic control is not addressed. No recognition of the passageway inlet with respect to exhaust outlet or exit is disclosed in the prior noted patents.

Therefore, a long-standing need has existed to provide a novel golf club head, particularly of the driver type, which includes frontal area reduction and means for reducing drag and for conducting oncoming ram air around or through the weighted mass of the club head so that friction and drag are eliminated or greatly reduced.

SUMMARY OF THE INVENTION

Accordingly, the above problems and difficulties are obviated by the present invention which provides a novel golf club head which includes a weighted mass having aerodynamic configuration across the top, sides and bottom or undersurface of the mass extending from a broad flat surface in front to a tapered rear portion of the mass. The head is characterized as having a top and undersurface which extends from a front face rearwardly in a downwardly sloping taper to terminate at a back side. The opposite sides of the head slope downwardly on the top surface and meet with the underside. Drag reduction means are provided which include a pair of arcuate passageways in spaced-apart relationship extending from the front face to the back side when the entrance at the front face takes the geometric form of a circular opening while the passageways exit at the back side in a geometric oval configuration. The underside is provided with a pair of raised ridges defining a central groove and opposite side grooves which terminate at the oval exit openings of the passageways. The arcuate radius of the passageways follows the arcuate path which the head follows as the golfer swings the golf club. Also, the openings in the front face for the passageway greatly reduce the area impacted by ram air.

Therefore, it is among the primary objects of the present invention to provide a novel golf club head which greatly reduces drag one the surface of the club head by using a pair of open-ended passageways that follow an arcuate radius while increasing the velocity of the golf head. As a result, the swing of the golf club will provide an increase in the distance of the ball hit. The two open-ended passageways along with the two contour arc ducts will also increase flight stability when swinging.

Another object of the present invention is to provide a golf head maintaining aerodynamics of the swing arc so that as the air flows through contoured holes and grooves on the golf head during the swing, the contour duct holes will steady the swing arc.

Still another object of the present invention is to provide a novel golf club having a head that includes a pair of round arcing ducts and ridges running parallel with the lower external ridges on the undersurface of the head which reduces the drag and increases lifting capability.

A further object resides in providing a golf head having arcuate ducts and ridges or passageways which provide greater stability and balancing appendages when swinging than can otherwise be obtained with conventional heads.

Still another object resides in providing a novel head for a golf club which follows the fundamental law of governing the motion of fluids in that the novel head which includes arcuate open-ended passageways and grooves formed in the underside of the head so that an increase in flow velocity provides a decrease in pressure so that greater distance gains can be achieved when hitting a golf ball.

Another object resides in the provision of a golf head composed of high strength-to-weight materials having a frontal area of reduced ram air impacting surface and which provides improved air flow over external surfaces.

Still a further object includes the provision of a sweet spot alignment indicator useful to the golfer in placement of the golf head with respect to the ball intended to be driven.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
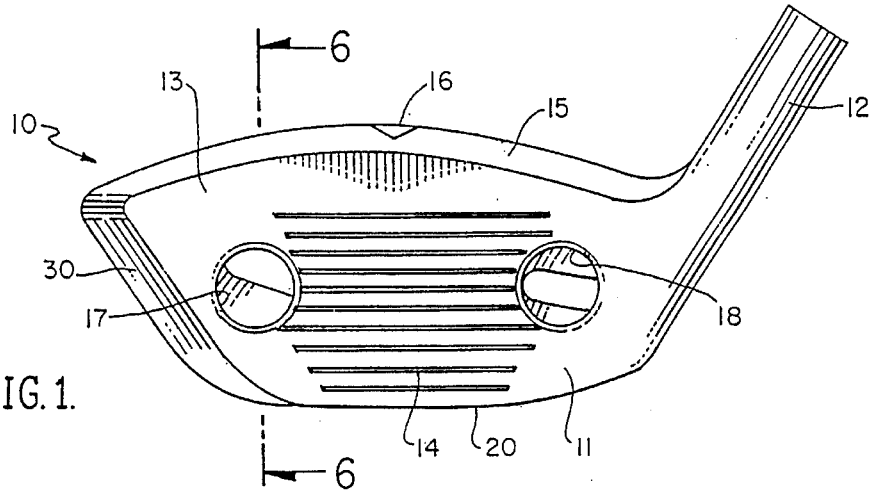
FIG. 1 is a front elevational view of the novel golf head incorporating the present invention.

Referring to FIG. 1, the novel golf club is indicated in the general direction of arrow 10 which includes a body or mass 11 having an outwardly projecting socket 12 for insertably receiving a shaft (not shown) having a golfer's hand grip at one end. The head 11 includes a substantial mass since the golf club itself is of the driver type. The head 11 is secured to the end of the shaft by means of a conventional crimp or other type connection.

The club head 11 includes an aerodynamically shaped and contoured overall peripheral surface. The front of the head includes a frontal surface or face 13 having a plurality of slits, such as slit 14, arranged in fixed parallel and horizontal relationship across the midsection of the front face 13. This area represents the sweet spot of the golf head and an upper contoured surface 15 includes a pointer 16 indicating alignment with the sweet spot so that a golfer has a visual alignment means for positioning the club with respect to a ball intending to be hit. It can be seen that the head 11 includes a pair of arcuate and open-ended passageways, identified by numerals 17 and 18 respectively. The front openings to the passageways are circular and the passageways are arranged in fixed spaced-apart relationship and separated by the plurality of slits 14 at the front face. FIG. 1 also indicates that each of the respective passageways terminate in a rear opening which may be defined as ovals, such as indicated in FIG. 2.

Figure 3:
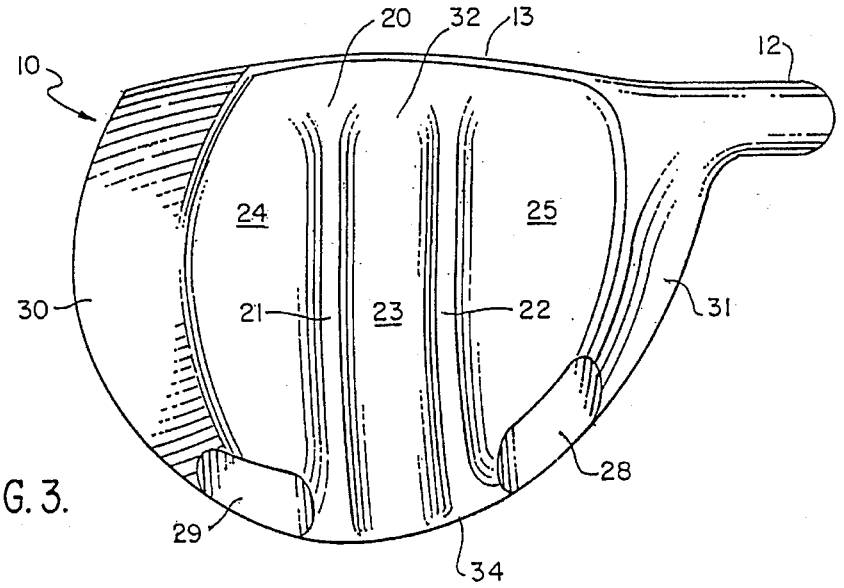
FIG. 3 is a bottom view of the golf head shown in FIGS. 1 and 2.

With respect to FIG. 3, the underside, indicated by numeral 20, includes a pair of spaced-apart ridges 21 and 22 which define a central groove 23 as well as side radii 24 and 25. The grooves are open and are intended to conduct the flow of ram air along the underside of the club to enhance lift during the striking of the ball. It is also to be noted that the oval exits of the passageway ducts 17 and 18 are immediately adjacent to the termination of grooves 24 and 25 respectively so that the flow of air through the passageways and on the side grooves merges in a smooth conduction of air exiting from the back side of the club.

Figure 2:
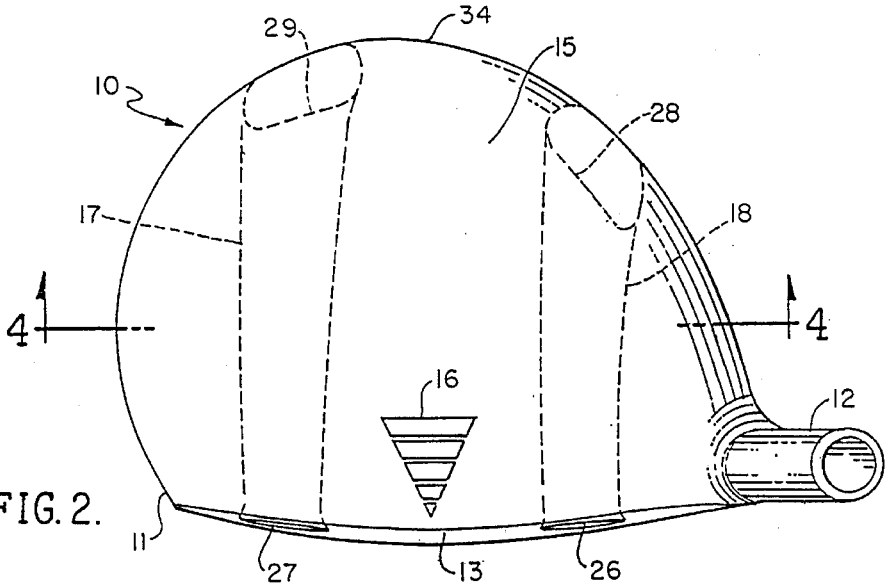
FIG. 2 is a top plan view of the golf head shown in FIG. 1.

Referring to FIGS. 2 and 3, the entrance openings which are circular are identified by numeral 26 with respect to passageway 18 and by numeral 27 with respect to passageway 17. The oval exit openings for the respective passageways are identified by numeral 28 with respect to passageway 18 and numeral 29 referring to the exit opening for passageway 17. It can be seen that the opposite sides of the club, as identified by numerals 30 and 31, are downwardly sloping or converging to meet at the opposite ends of the undersurface 20. The front face 13 is slightly curved between its opposite sides and is further curved from the top surface 15 to the undersurface 20. Therefore, it is to be understood that the striking surface or frontal surface 13 is not flat. The forward or front end of groove 23 includes a slight rise to the undersurface so as to provide a flat section 32 whereby oncoming ram air will enter the central groove 23 and be locked in while lateral air progresses through grooves 24 and 25 until reaching an exit at the rear side of the head which is identified by numeral 34.

Figure 4:
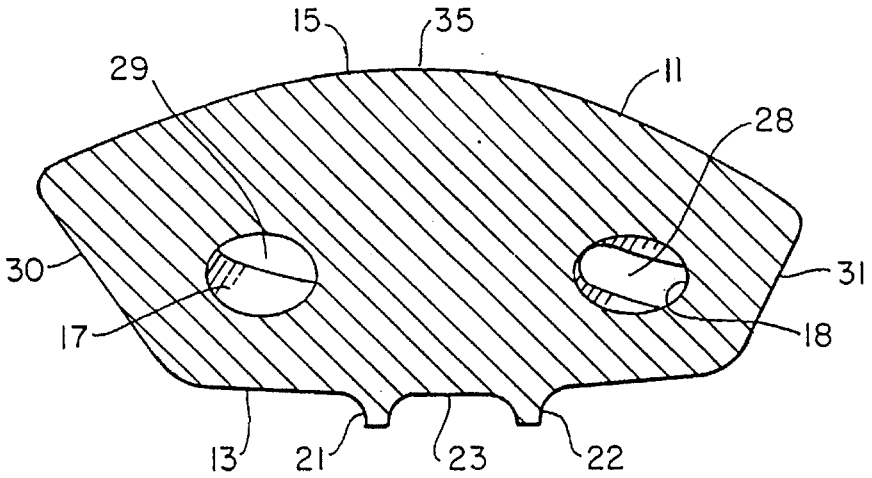
FIG. 4 is a transverse cross-sectional view of the golf head shown in FIG. 2 as taken in the direction of arrows 4—4 thereof.
Figure 5:
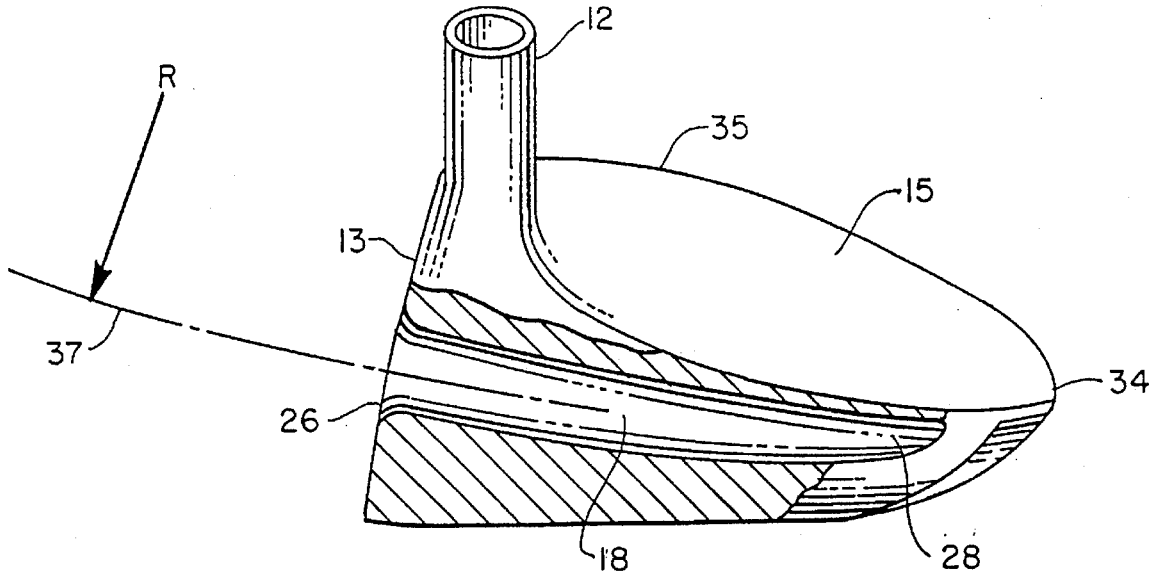
FIG. 5 is a side elevational view of the golf head shown in FIGS. 1–4 inclusive.

Referring now in detail to FIGS. 4 and 5, it can be seen that the sides 30 and 31 downwardly slope to meet with the opposite sides of undersurface 13 and that the central groove is defined between the ridges 21 and 22 respectively. The top surface 15 includes an uppermost apex 35 and downwardly slopes at its sides to merge with the opposite flat sides 30 and 31.

Referring to FIG. 5 in detail, it can be seen that the passageways 17 and 18 are arcuate and follow a radius equal to the arcuate path of the golfer's swing which is indicated by the numeral 37. Therefore, it can be seen that friction and drag is greatly reduced since the arc of the passageway matches the arc of the golfer's swing so that a clean and drag-free relationship exists between the oncoming ram air and the exposed surfaces of the club head. The air smoothly travels over the top, under and side surfaces so that a smooth flow joins at the back side 34 and does not create suction or an adverse holding or restricting force. The exhaust from the oval exits permits full discharge of air within the passageways so that entrapment does not exist.

Figure 6:
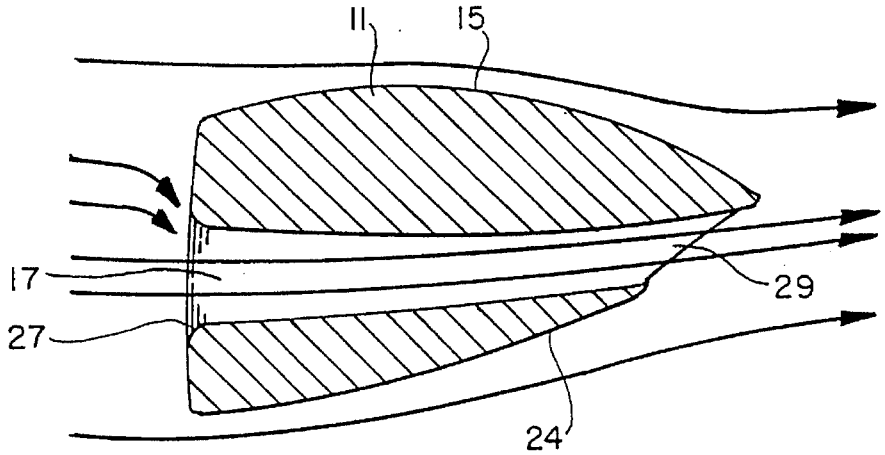
FIG. 6 is a transverse cross-section view of the golf club shown in FIG. 1 as taken in the direction of arrows 6—6 thereof.

Referring to FIG. 6, the oncoming ram air is indicated in the direction of the arrows which illustrates the aerodynamic airflow about the club head exterior and through the arcuate passageways such as passageway 17. The airflow follows the curved path defined by the curved sidewalls of the passageway. The curved airflow matches the arc of the golf club swing indicated in FIG. 5 by numeral 37. The airflow over the top and bottom surfaces is smooth and conducted into divided linear paths through the groove 23 or grooves or radii 24 and 25.

Figure 7:
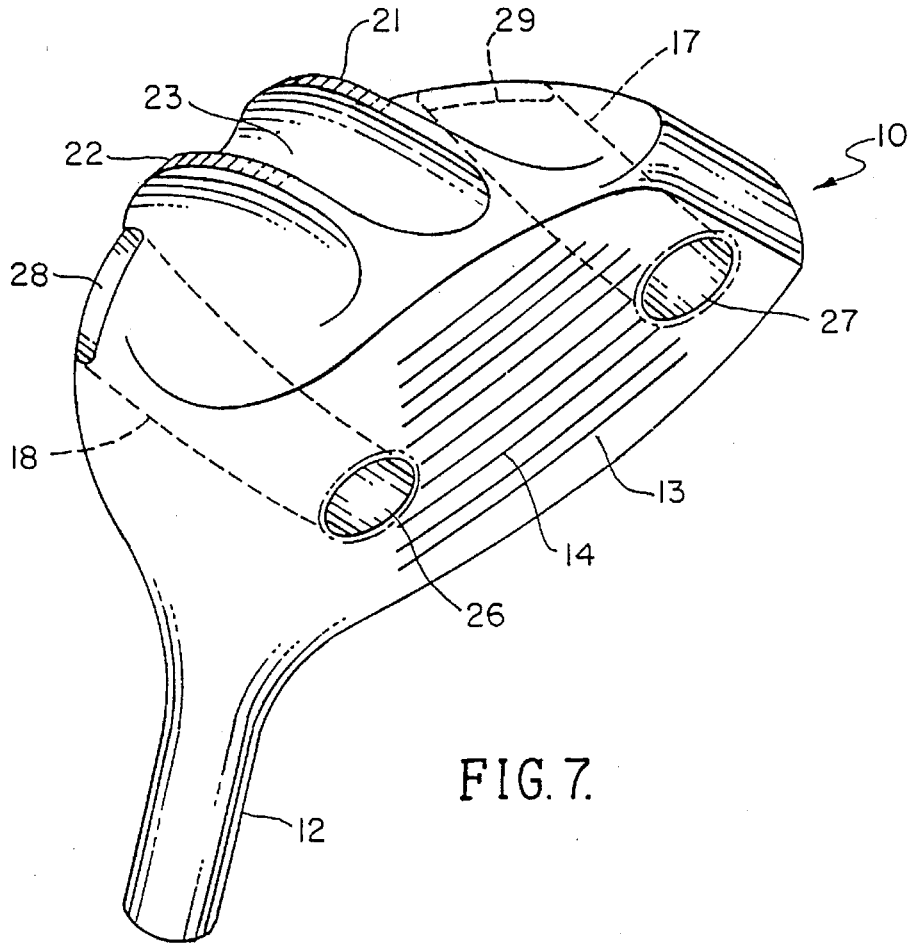
FIG. 7 is a perspective view of the golf club underside.

FIG. 7 clearly illustrates the ridges 21 and 22 that separate the control groove 23 from the lateral grooves 24 and 25 as well as the oval exit or exhaust outlets for the passageways as well as the circular inlets. The inlets are separated by the "sweet spot" on the front face and reduce the surface area which would normally cause drag and reduce club swing speed.

The passageways employ the fundamental law governing the motion of fluids which relates an increase in flow velocity to a decrease in pressure. Drag forces or resistence is decreased by the reduction in frontal face area impacted by ram air, by the arcuate passageways having larger exhaust outlets than the inlets and by the sole or undersurface grooves. The side grooves 24 and 25 allows airflow to slip laterally for dissipation past sides 30 and 31 while the central groove 23 locks in air. The ridges divide the lateral and central airflows which avoids creation of suction or boundary layer drag.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A golf club head comprising:

a body having weighted mass with a front face, a back end, opposite sides connecting said front face with said back end;

said body further having a top surface and an undersurface joining with said back end;

a pair of arcuate open-ended passageways provided in said body having a central curved axis following the arcuate swing of the golf club head;

one open end of each of said passageways being shaped as a circular opening with an opposite open end of each of said passageways being shaped as an oval opening;

said body undersurface being provided with a pair of spaced-apart ridges separated by a central groove and defining lateral grooves on opposite sides thereof;

said circular openings being located on said front face and said oval openings being located on said back end;

said front face having a ball impacting sweet spot separating said circular openings;

said ball impacting sweet spot having a multiplicity of parallel spaced-apart slits extending between said circular openings;

a visual indicator disposed on said top surface adjacent to said front face and between said circular openings displaying the location of said ball impacting sweet spot;

said body opposite sides downwardly and inwardly sloping from the periphery of said top surface to the periphery of said undersurface to terminate with said side grooves; and said body being of aerodynamic configuration having said top surface curved in a dome shape with said opposite sides sloping rearward from said front face to said back end in a curved manner to terminate with each of said oval openings respectively.

* * * * *